United States Patent [19]

Welker et al.

[11] 4,281,438

[45] Aug. 4, 1981

[54] FLAT COMBING MACHINE

[75] Inventors: Manfred Welker, Limbach-Oberfrohna; Hans-Joachim Scholz, Karl Marx Stadt, both of German Democratic Rep.

[73] Assignee: VEB Kombinat Textima, Karl Marx Stadt, German Democratic Rep.

[21] Appl. No.: 84,946

[22] Filed: Oct. 15, 1979

[30] Foreign Application Priority Data

Oct. 24, 1978 [DD] German Democratic Rep. ... 208629

[51] Int. Cl.[3] ..... D01G 19/10; D01G 19/16

[52] U.S. Cl. ..... 19/225; 19/235

[58] Field of Search ..... 19/115 R, 215, 225–228, 19/235

[56] References Cited

U.S. PATENT DOCUMENTS

| | | | |
|---|---|---|---|
| 1,678,822 | 7/1928 | Nasmith | 19/225 |
| 3,074,119 | 1/1963 | Gauvain | 19/227 |
| 3,184,799 | 5/1965 | Gauvain | 19/325 |
| 3,435,486 | 4/1969 | Itoh | 19/215 |
| 3,600,758 | 8/1971 | Von Kaenel | 19/225 |
| 4,079,632 | 3/1978 | Mori et al. | 19/225 |

FOREIGN PATENT DOCUMENTS

| | | | |
|---|---|---|---|
| 1242486 | 1/1960 | Fed. Rep. of Germany | 19/228 |
| 80640 | 8/1974 | German Democratic Rep. . | |
| 125422 | 4/1977 | German Democratic Rep. . | |

*Primary Examiner*—Louis Rimrodt

*Attorney, Agent, or Firm*—Nolte and Nolte

[57] ABSTRACT

The "cleaning-out" capability of a flat combing machine is increased by decreasing the distance between the jaw of the tong of the flat comber and the points of the opposed rows of needles on the round comber to a minimum distance and keeping this minimum distance constant. The needles are arranged on the round comber such that the radius of the needle points of the rows of needles lying side by side to the pivot of the round comber decreases, then increases, counter to the direction of rotation of the round comber. The tong is suspended by a pendulum and the distance between the pivot of the pendulum and the axis of the round comber is less than the sum of the maximum radius needle points to the pivot of the round comber, plus the minimum distance from the jaw of the tong to the needle points, plus the radius of the jaw of the tong to the pivot of the pendulum.

3 Claims, 5 Drawing Figures

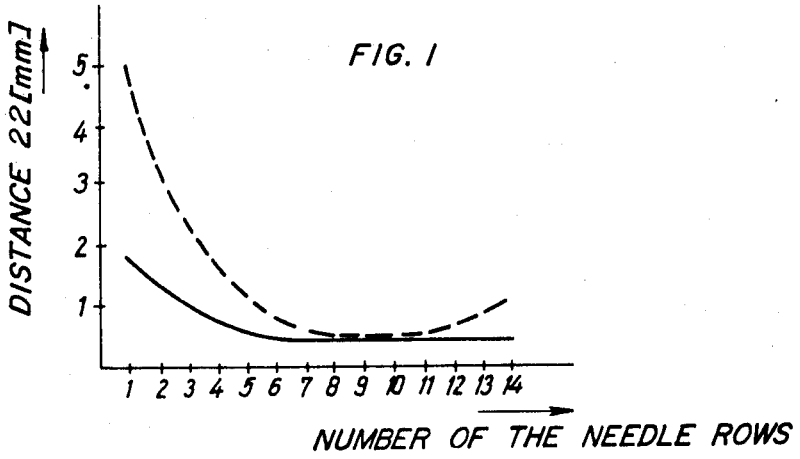
FIG. 2
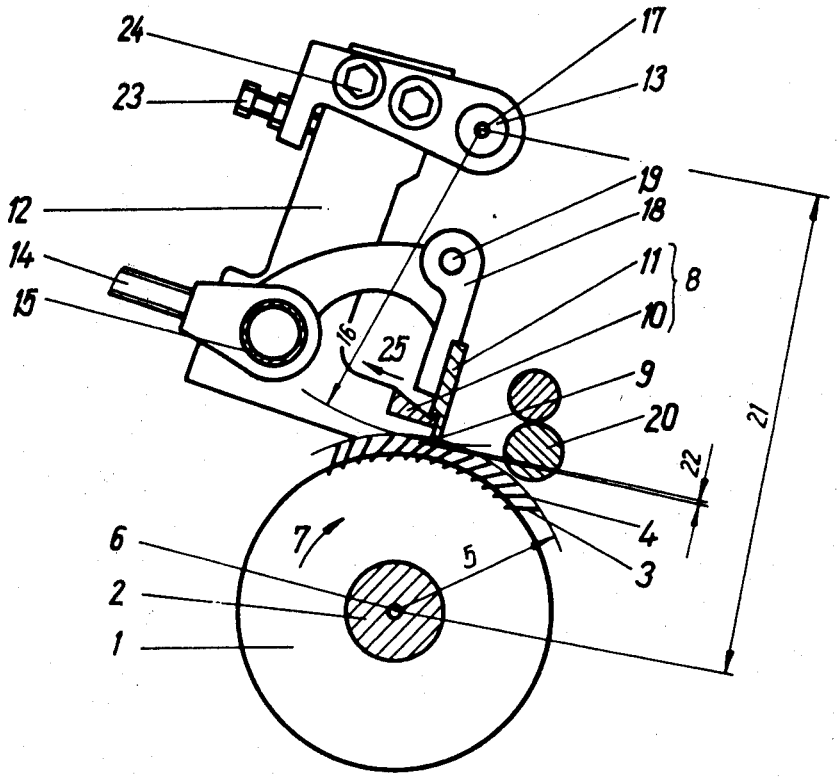

FLAT COMBING MACHINE

BACKGROUND OF THE INVENTION

The invention relates to the field of pretreatment of fibers and deals with a flat combing machine termed a flat comber, whereby the rows of needles are firmly and rigidly arranged on the round or circular comber and, whereby the tong or nippers, driven via a crankdrive mechanism, is mounted to a suspended pendulum.

CHARACTERISTICS OF THE KNOWN TECHNICAL SOLUTIONS

In the case of a known flat combing machine of the aforementioned type (as described in the Prospectus of the Cotton Combing Machine Model 1532 of the Kombinat VEB Spinnereimaschinenbau Karl-Marx-Stadt and as disclosed in DD-Pat. Nos. 80 640 and 125 422), the points of the needles of the adjoining rows of needles are arranged concentrically to the center of the round or circular comber. If the flat combing machine is working, the points of the needles move along an orbit which is concentric to the pivot point of the round comber, and the jaw of the tong (nippers) moves along an orbit which is concentric to the pivot point of the tong. During the main combing procedure, the tong (nippers) carries out a retrograde motion. During this process, the distance between the jaw of the tong and the points of the needles of the opposite row of needles changes, whereby the distance at the first row of needles is the maximum distance, which decreases thereafter, reaches a minimum distance between the eighth and tenth row of needles, and increases thereafter up to the fourteenth row of needles, as it is illustrated by the dotted line in the diagram of FIG. 1. Ordinarily, depending upon the setting or adjustment, the minimum distance between the jaw of the tong (nippers) and the points of the needles amounts to 0.3 to 0.5 mm. The disadvantage here is that the "cleaning-out" degree is decreased, if the distance between the jaw of the tong and the points of the opposite-located row of needles is larger than the minimum distance.

OBJECT OF THE INVENTION

It is the object of the invention to increase the "cleaning-out" degree.

SUMMARY OF THE INVENTION

The technical task which is being solved through the invention consists of decreasing the distance between the jaw of the tong and the points of the respective opposite-located row of needles and of keeping it almost constant in the range of the fine needles after the minimum value has been reached.

According to the invention, this is achieved in the following manner: the distance between the pivot of the round (circular) comber and the pivot of the suspended pendulum is smaller than the sum of the maximum radius of the needle points to the pivot of the round comber, the minimum distance between the jaw of the tong and the points of the needles and the radius of the jaw of the tong to the pivot of the suspended pendulum. At the same time, the radius of the needle points to the pivot of the round (circular) comber of the rows of needles lying side by side must decrease at first, counter to the direction of rotation of the round comber, and increase afterwards.

A preferred embodiment is one whereby the points of the needles of the rows of needles lying side by side are located on a radius which is larger than the maximum radius of the needle points to the pivot of the round comber.

Another embodiment is one whereby a rotating shaft or rocker arm is located ahead of the suspended pendulum carrying the lower tong and the link or joint between this rotating shaft and the appertaining coupler is fastened in a curved elongated hole or slot and whereby the center of the radius of the curved elongated hole (slot) in the rear end position of the tong is located in the opposite-located pivot of the coupler. This assures that the rear end position of the tong (nippers) remains constant when the "tear-off" distance is adjusted.

BRIEF DESCRIPTION OF THE DRAWINGS

Depicted in the attached drawings are:

FIG. 1: The diagram showing the change of the distance between the jaw of the tong (nippers) and the respective opposite-lying row of needles.

FIG. 2: A simplified side elevation in cross section, with the round (circular) comber, the tong (nippers) and the "tear-off" or web-breaking roller.

Figure 3:
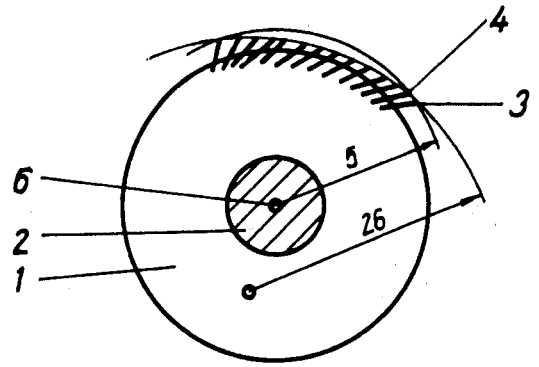
FIG. 3: A simplified side elevation in cross section of the round (circular) comber for another embodiment.

The round comber 1 is fastened on the round comber shaft 2 (FIG. 2). Arranged on the round comber 1, in a manner not shown here, are the rows of needles 3 with the needles 4. The radius 5 of the points of the needles 4 to the pivot 6 of the round comber 1 of the needle rows 3 lying side by side decreases at first, counter to the direction of rotation 7 of the round comber 1, and increases afterwards.

In the first and fourteenth row 3, counter to the direction of rotation 7, the radius 5 reaches its maximum value and, approximately between the eighth to the tenth row 3, its minimum value. Located above the round (circular) comber 1 is the tong (nippers) 8 with its jaw 9 which consists of the lower tong 10 and the upper tong 11. The lower tong 10 is fastened to the driven rotating shaft (rocker arm) designed in the form of a suspended pendulum 12 which can be rotated around the tong axis 13. The suspended pendulum 12 receives its impulse or movement via coupler 14 which is connected with the suspended pendulum 12 with the pipe or tube 15. The jaw 9 of the tong 8 swings to the radius 16 around the pivot 17 of the suspended pendulum 12. The upper tong 11 is fastened to the rotating shaft 18 which can be rotated around the pipe (tube) 15. The drive (not shown here) causing the lifting and lowering of the upper tong 11, engages at the joint 19 of the rotating shaft 18. Behind the round comber 1 and the tong 8, the pair of "tear-off" (web breaking) rollers 20 is attached in the vicinity of the round comber 1. The round comber 1 and the tong 8 are arranged in such a manner that the distance 21 between the pivot 6 of the round comber 1 and the pivot 17 of the suspended pendulum 12 is smaller than the sum of the maximum radius 5 of the needle points 4 to the pivot 6 of the round comber 1, the minimum distance 22 between the jaw 9 of the tong 8 and the points of the needles 4, and the radius 16 of the jaw 9 of the tong 8 to the pivot 17 of the suspended pendulum 12. Ordinarily, depending upon the setting (adjustment), the minimum distance 22 amounts to 0.3 to 0.5 mm, when the jaw 9 of the tong 8 is located opposite the eighth to the tenth row of needles 3 of the round comber 1. In order to adjust the minimum distance 22, the suspended pendulum 12 consists of two parts and is provided with the adjusting screw 23 and the tightening screws 24.

If the flat combing machine is in operation, the round comber 1 moves in the direction of rotation 7. During the main combing process, the tong 8 carries out a retrograde motion in the direction 25. Hereby, the distance 22 between the jaw 9 of the tong 8 and the needle points 4 of the respective opposite-located needle row 3 undergoes a change. This change of the distance 22 is illustrated by the solid line in the diagram according to FIG. 1. At the first row of needles 3, the distance reaches a maximum, decreases thereafter, reaches a minimum distance between the eighth and the tenth row of needles 3 and remains almost constant up to the fourteenth row of needles 3. The reduction of the distance 22, as compared to the aforementioned known technical solution, as shown by the dotted line, can also be seen in the diagram according to FIG. 1.

In another type of embodiment (FIG. 3), the points of the needles 4 of the needle rows 3, lying side by side, are located at a radius 26 which is larger than the maximum radius 5 of the needle points 4 to the pivot 6 of the round comber 1.

Figure 4:
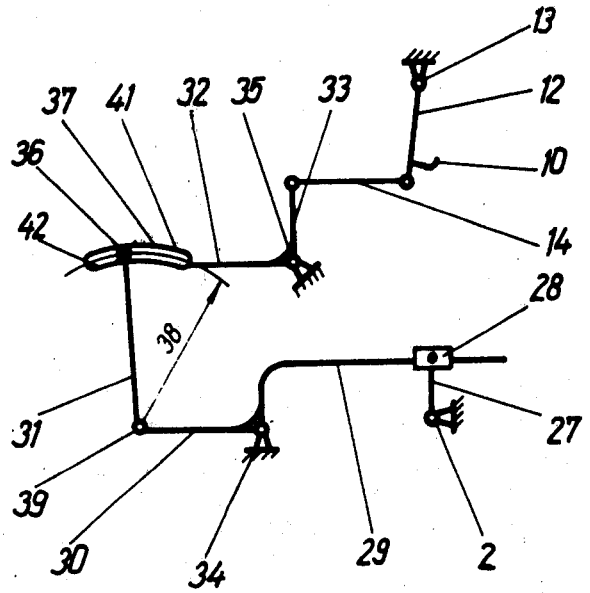
FIG. 4: A schematic presentation of the crankdrive mechanism for the propulsion of the tong (nippers).
Figure 5:
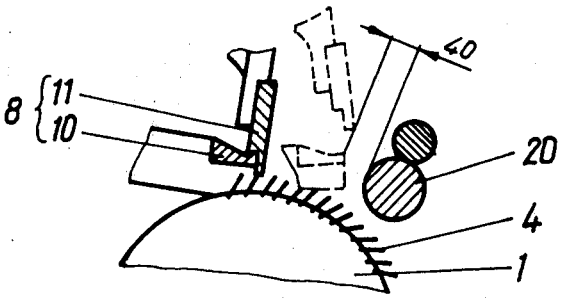
FIG. 5: A side elevation in cross section showing in detail a portion of the apparatus of FIG. 2.

The embodiment according to FIG. 4 shows a crankdrive mechanism for the propulsion of the tong 8. The crankdrive mechanism is composed of a crossed oscillating or swinging crank guide which, in turn, consists of the crank 27, the slide ring 28 and the rotating shaft (rocker arm) 29, and two double rockers, whereby the first double rocker consists of the rotating shafts 30, 32 and the coupler 31, and the second double rocker consists of the rotating shaft 33, the coupler 14 and the driven rotating shaft which is designed in the form of a suspended pendulum 12. Whereas the crank 27 is fastened to the axle of the round comber 2 and the suspended pendulum 12 is swingable around the tong axis 13, the rotating shafts 29, 30—which are rigidly (solidly) comnected with each other—are swingable around the axle 34 and the rotating shafts 32, 33—which are also rigidly connected with each other—are swingable around the lower tong axle 35. At the rotating shaft 32, which is located in front (ahead) of the suspended pendulum 12 that carries the lower tong 10, the joint 36 is fastened in a curve elongated hole (slot) 37 between this rotating shaft 32 and the appertaining coupler 31, whereby the center of the radius 38 of the curved elongated hole in the rear end position of the tong 8 is located in the opposite-located pivot of the coupler 31. The adjustment (setting) of the rear end position of the tong 8 (FIG. 5, tong 8 in solid line) is carried out in dependency of the largest fiber length which is to be worked on. After the adjustment of the rear end position of the tong 8, the position of the needle points 4 of the needle rows 3 is fixed, whereby in the case of the embodiment according to FIG. 3 the radius 26 is established. The "tear-off" distance 40 between the pair of "tear-off" (web breaking) rollers 20 and the tong 8 in its front end position (FIG. 5, tong 8 in dotted line) is being adjusted by moving the joint 36 in the curved elongated hole (slot) 37, depending upon the degree or extent of the combing-out. The "tear-off" distance 40 (FIG. 5) reaches the minimum value when the joint 36 in the curved elongated hole is in the position 41 (FIG. 4) and the maximum value when the joint 36 is in the position 42. The constant rear end position of the tong 8 makes it possible that the minimum distance 22 (FIG. 2) reached between the eighth and tenth row of needles 3 remains almost constant up to the fourteenth needle row 3, even if the "tear-off" distance 40 (FIG. 5) is shifted (adjusted); all this without having to change the position of the needle points 4 of the needle rows 3 or, additionally, the stroke of the tong 8.

We claim:

1. Flat combing machine whereby the needle rows are rigidly and solidly arranged on the round comber and the tong, driven by a crankdrive mechanism, is fastened to a suspended pendulum, characterized by the fact that the distance (21) between the pivot (6) of the round comber (1) and the pivot (17) of the suspended pendulum (12) is smaller than the sum of the maximum radius (5) of the needle points (4) to the pivot (6) of the round comber (1), plus the minimum distance (22) between the jaw (9) of the tong (8) and the points of the needles (4) and plus the radius (16) of the jaw (9) of the tong (8) to the pivot (17) of the suspended pendulum (12), wherein the radius (5) of the needle points (4) to the pivot (6) of the round comber (1) of the needle rows (3), lying side by side to each other, decreases at first and subsequently increases, counter to the direction of rotation (7) of the round comber (1).

2. Flat combing machine according to claim 1, characterized by the fact that the needle points (4) of the needle rows (3), lying side by side to each other corresponding to the increased radius from the pivot of the round comber to the needle points, are located on a radius (26) which is larger that the maximum radius (5) of the needle points (4) to the pivot (6) of the round comber (1) corresponding to the decreased radius.

3. Flat combing machine according to claim 1, characterized by the fact that at a rotating shaft (32) which is located in front of the suspended pendulum (12) carrying the lower tong (10), the joint (36) is fastened in a curved elongated slot (37) between the aforementioned rotating shaft (32) and the appertaining coupler (31) and that the center of the radius (38) of the elongated curved slot (37) in the rear end position of the tong (8) is located in the opposite-located pivot (39) of the coupler (31).

* * * * *